US006161700A

United States Patent [19]

Bakula

[11] Patent Number: 6,161,700

[45] Date of Patent: Dec. 19, 2000

[54] VIBRATORY SCREENING SCREEN AND METHOD OF FABRICATION THEREOF

[75] Inventor: John J. Bakula, Grand Island, N.Y.

[73] Assignee: Derrick Manufacturing Corporation, Buffalo, N.Y.

[21] Appl. No.: 09/407,513

[22] Filed: Sep. 28, 1999

[51] Int. Cl.[7] ..... B07B 1/49

[52] U.S. Cl. ..... 209/401; 209/392; 209/363; 209/233

[58] Field of Search ..... 209/392, 401, 209/402, 403

[56] References Cited

U.S. PATENT DOCUMENTS

| | | | |
|---|---|---|---|
| 3,049,235 | 8/1962 | Newburg | 209/346 |
| 3,716,138 | 2/1973 | Lumsden | 209/401 |
| 5,626,234 | 5/1997 | Cook et al. | 209/315 |

*Primary Examiner*—Donald P. Walsh
*Assistant Examiner*—Jonathan R. Miller
*Attorney, Agent, or Firm*—Joseph P. Gastel

[57] ABSTRACT

A screening screen having openings in the warp direction which are longer than these openings in the woof direction including warp wires and woof wires of the same maximum size extending at substantially maximum warp and woof crimp angles relative to each other which will not permit the warp wires and the woof wires to slide relative to each other. A method of fabricating a screening screen of the above type including the steps of determining the size of the openings in the woof direction and determining the maximum wire size of the warp and woof wires which will produce a maximum woof crimp angle which will not permit the woof wires to slide relative to the warp wires in the woof direction, and determining the length of the openings in the warp direction which will produce a substantially maximum warp crimp angle which will not permit the warp wires to slide relative to the woof wires in the warp direction.

4 Claims, 2 Drawing Sheets

TABLE

| U.S.OPENING | WOOF WIRES PER INCH | WARP WIRES PER INCH | WIRE DIA. INCHES | OPEN AREA % | L/W RATIO | OPENING % ERROR | WARP CRIMP ANGLE B° | WOOF CRIMP ANGLE A° | WIRE DIA. VOL. GAIN |
|---|---|---|---|---|---|---|---|---|---|
| 50 | 20 | 54 | 0.0068 | 54.6% | 3.68 | 0.20% | 164.5 | 139.6 | 65% |
| 60 | 22 | 63 | 0.006 | 54.0% | 3.98 | 0.30% | 164.9 | 138.5 | 68% |
| 70 | 27 | 74 | 0.0052 | 52.8% | 3.8 | 0.60% | 164 | 137.9 | 67% |
| 80 | 32 | 89 | 0.0043 | 53.0% | 3.88 | -0.50% | 164 | 138 | 66% |
| 100 | 38 | 106 | 0.0036 | 53.0% | 3.89 | -0.50% | 164.4 | 138.2 | 63% |
| 120 | 47 | 126 | 0.003 | 53.4% | 3.7 | 0.30% | 163.9 | 138.5 | 60% |
| 140 | 54 | 150 | 0.0025 | 54.0% | 3.84 | 0.80% | 164.6 | 138.8 | 45% |
| 170 | 65 | 180 | 0.0021 | 53.2% | 3.84 | 0.00% | 164.4 | 138.5 | 60% |
| 200 | 77 | 212 | 0.0018 | 53.0% | 3.83 | 0.00% | 164.2 | 138.2 | 50% |
| 230 | 92 | 254 | 0.0015 | 53.0% | 3.84 | 0.00% | 164.2 | 138.2 | 49% |
| 270 | 105 | 286 | 0.0013 | 54.2% | 3.74 | -0.50% | 164.5 | 139.2 | 41% |
| 325 | 125 | 352 | 0.0011 | 52.5% | 3.78 | 0.50% | 164.7 | 137.7 | 17% |
| 400 | 155 | 425 | 0.0009 | 53.0% | 3.82 | -0.30% | 164 | 138 | -23% |

FIG.4

VIBRATORY SCREENING SCREEN AND METHOD OF FABRICATION THEREOF

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to an improved vibratory screening screen which has the desirable attributes of relatively high conductance, long wear and precise openings which do not vary in use, and to a method of fabrication thereof.

By way of background, there are in use vibratory screening screens in which the warp dimension is longer than the woof dimension. In the past it was difficult to fabricate such screens without permitting relative sliding movement between the warp wires and the woof wires while the screen was in operation on a vibratory screening machine. This resulted in situations wherein the cut, namely, the precision of screening, was not maintained. It is with overcoming the foregoing deficiencies of the prior art that the present invention is concerned.

BRIEF SUMMARY OF THE INVENTION

It is one object of the present invention to provide a screening screen wherein the warp dimension is longer than the woof dimension and which utilizes a maximum wire size to produce relatively long screen life and which will accurately maintain the screening openings constant in use.

Another object of the present invention is to provide an improved method of fabricating a screening screen wherein the warp openings are longer than the woof openings and which will utilize a maximum wire size for producing relatively long life and wherein the warp wires and the woof wires will maintain their spacing in use. Other objects and attendant advantages of the present invention will readily be perceived hereafter.

The present invention relates to a screening screen having openings in the warp direction which are longer than said openings in the woof direction comprising warp wires and woof wires of substantially the same size, said openings in the woof direction being of a predetermined size, said woof wires being of a substantially maximum size which will produce a substantially maximum woof crimp angle which will not permit said woof wires to slide relative to said warp wires in the woof direction, and said warp wires being of said substantially maximum size and being spaced a substantially maximum amount in the warp direction which will produce a substantially maximum warp crimp angle which will not permit said warp wires to slide relative to said woof wires in the warp direction.

The present invention also relates to a method of fabricating a screening screen having openings in the warp direction which are longer than said openings in the woof direction, selecting the size of the openings in the woof direction, providing warp wires and woof wires of substantially the same maximum size which will provide a substantially maximum woof crimp angle which will not permit said woof wires to slide relative to said warp wires in the woof direction at said size of said opening in said woof direction, and spacing said woof wires in the warp direction a substantially maximum amount which will produce a substantially maximum warp crimp angle which will not permit said warp wires to slide relative to said woof wires in the warp direction.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 4 is a table showing the range of warp crimp angles and woof crimp angles, the maximum diameter of the wire for providing different size openings and related data.

DETAILED DESCRIPTION OF THE INVENTION

As noted above, the desirable attributes of a screening screen is to have relatively high conductance, long wear and precise openings which do not vary in use. To obtain long wear, the wire size has to be as large as possible consistent with the openings between the wires. However, the maximum size of the wires is determined by the maximum woof crimp angle which can be obtained consistent with the openings between the warp wires. This maximum woof crimp angle is such that the woof wires will not slide in the woof direction relative to the warp wires. Once the foregoing woof crimp angle has been established, the maximum warp crimp angle has to be such that it will provide the maximum screen opening in the warp direction without permitting the warp wires to slide in the warp direction relative to the woof wires.

Figure 1:
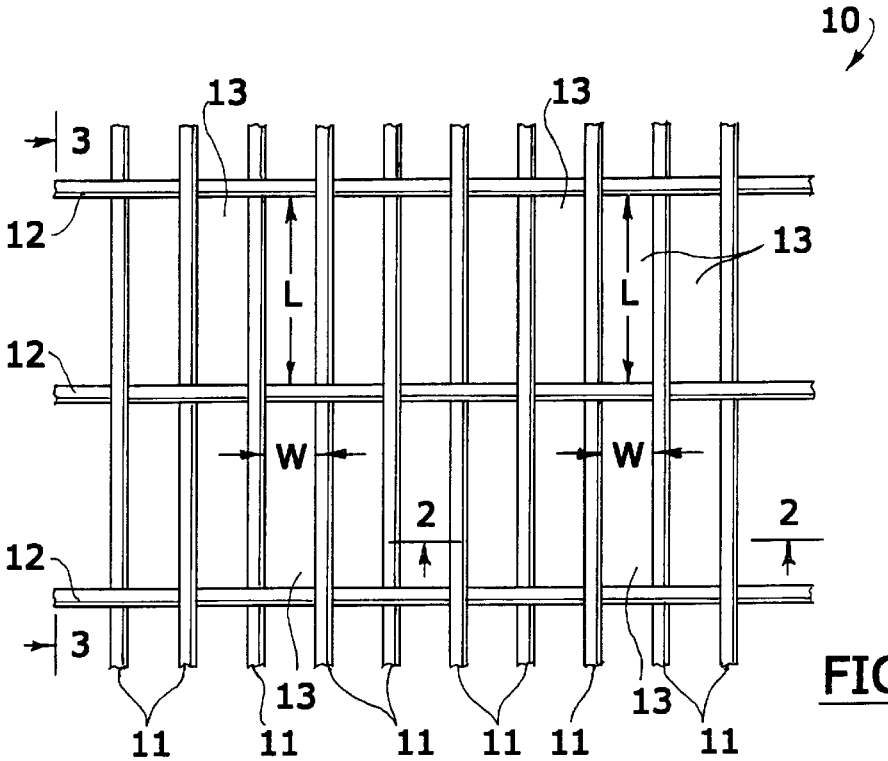
FIG. 1 is a fragmentary schematic plan view of the improved screening screen of the present invention wherein the size of the openings is longer in the warp dimension than in the woof dimension.

In FIG. 1 there is a fragmentary representation of a screening screen 10 having warp wires 11 and woof wires 12 with the openings 13 of a size L between the woof wires 12 and having a size W between the warp wires 11.

Figure 2:
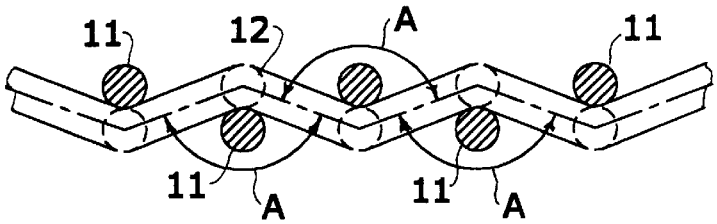
FIG. 2 is a schematic view taken substantially in the direction of arrows 2—2 of FIG. 1 and showing the crimp angle of the woof wires.
Figure 3:
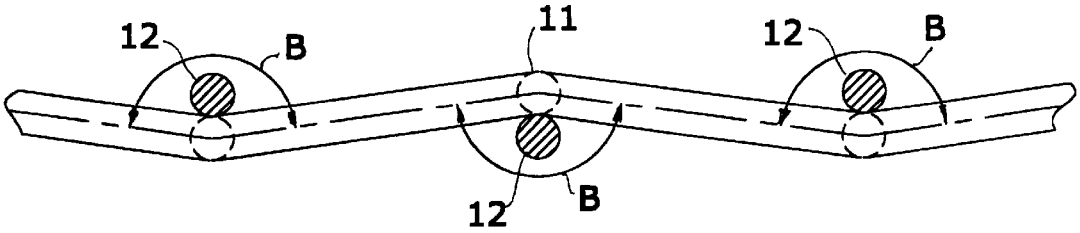
FIG. 3 is a schematic view taken substantially in the direction of arrows 3—3 and showing the crimp angle of the warp wires.

In FIG. 2 it is seen that there is a woof crimp angle A where the woof wires 12 cross the warp wires 11. In FIG. 3 there is a warp crimp angle B where the warp wires 11 cross the woof wires 12. As can be seen from FIG. 2, the woof crimp angle A is measured along the centers of the woof wires 12. As can be seen from FIG. 3 the warp crimp angle B is measured along the centers of the warp wires 11.

In FIG. 4 there is a table of the U.S. openings, from opening 50 through opening 400. The table sets forth the woof wires and the warp wires per inch for each opening. It has been determined from experimentation that the substantially maximum wire diameter for each opening is as listed in the table. Additionally, it is to be noted that the woof crimp angle A varies between 137.7 and 139.6 for the entire range of wire sizes for all of the openings. In other words, the woof crimp angles A remain within a relatively narrow range regardless of the large changes in the maximum wire diameters which can be used for each opening. The warp crimp angles B range between 163.9 and 164.9 for the entire range of wire sizes between the U.S. openings 50 and 400. This narrow range exists while the wire diameters vary substantially between the openings 50 and 400.

It is also to be noted that the L/W ratio, that is the ratio of the openings 13 of their length dimension to their width dimension, remains within the range of between 3.7 and 3.98 for all U.S. openings.

Considering the foregoing basically empirical relationships, it can be concluded that the maximum wire size for a particular opening 13 should provide a woof crimp angle of between about 137.7 and 139.6 and a warp crimp angle B of between about 163.9 and 164.9. In other words, when the maximum opening is provided at which the woof wires will not slide in the woof direction relative to the warp wires and the warp wires will not slide in the warp direction relative to the woof wires, the woof crimp angles should fall between 137.7 and 139.6 and the warp crimp angles should fall between 163.9 and 164.9.

The table of FIG. 4 shows the maximum wire size which can be utilized for each U.S. opening, and it sets forth the length to width ratio for each opening and the woof crimp angle and the warp crimp angle which should exist.

When the parameters of the table of FIG. 4 are followed, a screen will be provided wherein the openings in the warp direction are longer than the openings in the woof direction and wherein the size of the wires is of a maximum diameter to provide long wear and wherein the woof wires and the warp wires have crimp angles which will prevent relative sliding therebetween. Additionally, in the table the maximum wire sizes will maintain the openings 13 therebetween substantially constant when the screen is subjected to vibrations of magnitudes up to about 9 G's in a vibratory screening machine.

To obtain the data in the table of FIG. 4, a 316 drawn stainless steel type of wire was used, and this wire is typically used in screening screens. However, it is believed that other grades of wire will produce similar results within the scope of the broader claims.

While preferred embodiments of the present invention have been disclosed, it will be appreciated that the present invention is not limited thereto but may be otherwise embodied within the scope of the following claims.

What is claimed is:

1. A screening screen having a dimiension of the openings in the warp direction which in longer than the dimension of the openings in the woof direction comprising warp wires and woof wires of substantially the same size, said dimension of the openings in the woof direction being of a predetermined size, said woof wires being of a substantially maximum size which will produce a substantially maximum woof crimp angle of between about 137.7 and 139.6 degrees which will not permit said woof wires to slide relative to said warp wires in the woof direction, and said warp wires being of said substantially maximum size and being spaced a substantially maximum amount In the warp direction to produce said dimension of said openings in the warp direction which is longer than said dimension of said openings in the woof direction and which will produce a substantially maximum warp crimp angle between about 163.9 and 164.9 degrees which will not permit said warp wires to slide relative to said woof wires in the warp direction.

2. A screening screen as set forth in claim 1 wherein said warp wires range between about 54 and 425 wires per inch having diameters of between about 0.0068 inches and 0.0009 inches, respectively.

3. A method of fabricating a screening screen having a dimension of the openings in the warp direction which is longer than the dimension of openings in the woof direction, comprising the steps of selecting the size of the dimension of the openings in the woof direction, providing warp wires and woof wires of substantially the same maximum size which will provide a substantially maximum woof crimp angle of between about 137.7 and 139.6 degrees which will not permit said woof wires to slide relative to said warp wires in the woof direction at said size of said dimension of said openings in said woof direction, and spacing said woof wires in the warp direction a substantially maximum amount which is longer than said dimension of said openings in said woof direction and which will produce a substantially maximum warp crimp angle of between about 163.9 and 164.9 degrees which will not permit said warp wires to slide relative to said woof wires in the warp direction.

4. A method as set forth in claim 3 wherein said warp wires range between about 54 and 425 wires per inch having diameters of between about 0.0068 and 0.0009 inches, respectively.

* * * * *